US009506136B2

(12) United States Patent
Magdefrau et al.

(10) Patent No.: US 9,506,136 B2
(45) Date of Patent: Nov. 29, 2016

(54) METHOD OF COATING AN IRON-BASED ARTICLE

(75) Inventors: Neal Magdefrau, Tolland, CT (US); James T. Beals, West Hartford, CT (US); Ellen Y. Sun, South Windsor, CT (US); Jean Yamanis, South Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 987 days.

(21) Appl. No.: 13/613,188

(22) Filed: Sep. 13, 2012

(65) Prior Publication Data

US 2015/0368781 A1 Dec. 24, 2015

(51) Int. Cl.

| | |
|---|---|
| ***C23C 8/10*** | (2006.01) |
| ***C23C 10/48*** | (2006.01) |
| *B32B 15/20* | (2006.01) |

(52) U.S. Cl.

CPC ..... *C23C 8/10* (2013.01)

(58) Field of Classification Search

CPC ..... C23C 8/10; C23C 10/08; C23C 10/20; C23C 10/48; C23C 10/50; B32B 15/012; B32B 15/20

See application file for complete search history.

(56) References Cited

U.S. PATENT DOCUMENTS

| | | | |
|---|---|---|---|
| 3,764,371 | A | 10/1973 | Baldi |
| 4,004,047 | A | 1/1977 | Grisik |
| 5,098,540 | A | 3/1992 | McKee |
| 5,591,531 | A | 1/1997 | Jasper |
| 5,674,610 | A | 10/1997 | Schaeffer et al. |
| 6,022,632 | A | 2/2000 | Olson |
| 6,045,863 | A | 4/2000 | Olson et al. |
| 6,110,262 | A | 8/2000 | Kircher et al. |
| 6,283,715 | B1 | 9/2001 | Nagaraj et al. |
| 6,585,864 | B1 | 7/2003 | Fisher et al. |
| 7,745,029 | B2 | 6/2010 | Jackson et al. |
| 8,084,094 | B2 | 12/2011 | Gorman et al. |
| 2005/0265851 | A1 | 12/2005 | Madhava et al. |
| 2010/0119866 | A1* | 5/2010 | Perepezko ..... B32B 15/012 428/621 |

OTHER PUBLICATIONS

Cuevas et al., "Aluminizing of Stainless Steel", NACE-2012-1710, NACE International, Corrosion 2012 Conference & Expo, Mar. 11-15, 2012.*

U.S. Appl. No. 13/536,141, entitled Chromium Diffusion Coating, filed Jun. 28, 2012.

* cited by examiner

*Primary Examiner* — Lois Zheng

(74) *Attorney, Agent, or Firm* — Carlson, Gaskey & Olds, P.C.

(57) ABSTRACT

A method of coating an iron-based article includes a first heating step of heating a substrate that includes an iron-based material in the presence of an aluminum source material and halide diffusion activator. The heating is conducted in a substantially non-oxidizing environment, to cause the formation of an aluminum-rich layer in the iron-based material. In a second heating step, the substrate that has the aluminum-rich layer is heated in an oxidizing environment to oxidize the aluminum in the aluminum-rich layer.

16 Claims, 1 Drawing Sheet

METHOD OF COATING AN IRON-BASED ARTICLE

STATEMENT REGARDING FEDERALLY SPONSORED RESEARCH OR DEVELOPMENT

This invention was made with government support under contract number DE-NT0003894 awarded by United States Department of Energy. The government has certain rights in the invention.

BACKGROUND

Aluminide diffusion coatings are known and used on components made from nickel-based superalloys. The process for applying the aluminide coating on the nickel-based superalloy typically includes high-vacuum processes, such as packed bed processing, above the pack processing or chemical vapor deposition.

SUMMARY

A method of coating an iron-based article according to a non-limiting exemplary aspect of the present disclosure includes, in a first heating step, heating a substrate including an iron-based material in the presence of an aluminum source material and a halide diffusion activator, in a substantially non-oxidizing environment, to cause the formation of an aluminum-rich layer on at least a portion of the iron-based material. In a second heating step, the substrate that has the aluminum-rich layer is heated in an oxidizing environment to oxidize the aluminum in the aluminum-rich layer.

In a further non-limiting embodiment, the first heating step includes heating at a heating temperature such that a ratio of the melting temperature of the iron-based material to the heating temperature is 1.5-2.1.

In a further non-limiting embodiment of any of the foregoing examples, the first heating step includes heating at a heating temperature such that a ratio of the melting temperature of the iron-based material to the heating temperature is 1.6-1.9.

In a further non-limiting embodiment of any of the foregoing examples, the second heating step is conducted at a heating temperature of 800°-1000° C.

A further non-limiting embodiment of any of the foregoing examples includes, after the second heating step, cooling the substrate that has the alumina at a cooling rate that is equal to or less than 10° C. per minute.

A further non-limiting embodiment of any of the foregoing examples includes, after the second heating step, cooling the substrate that has the alumina at a cooling rate of 1°-2° C. per minute.

In a further non-limiting embodiment of any of the foregoing examples, the first heating step is conducted at a temperature of 750°-850° C.

In a further non-limiting embodiment of any of the foregoing examples, the first heating step is conducted at a temperature of 800°-825° C.

In a further non-limiting embodiment of any of the foregoing examples, the iron-based material is stainless steel.

In a further non-limiting embodiment of any of the foregoing examples, the heating of the first heating step is conducted at a pressure of 14.7-19.7 psia.

In a further non-limiting embodiment of any of the foregoing examples, the substantially non-oxidizing environment includes hydrogen in an amount of up to 4 vol %.

In a further non-limiting embodiment of any of the foregoing examples, the substrate is at least partially enclosed in a titanium-containing enclosure.

In a further non-limiting embodiment of any of the foregoing examples, the substrate is at least partially enclosed in a tantalum-containing enclosure.

A further non-limiting embodiment of any of the foregoing examples includes providing the aluminum source material and the halide diffusion activator in a slurry, and applying the slurry on the iron-based material.

In a further non-limiting embodiment of any of the foregoing examples, the heating of the first heating step includes heating at a heating temperature such that a ratio of the melting temperature of the iron-based material to the heating temperature is 1.5-2.1 and, after the second heating step, cooling the substrate at a rate of 1°-2° C. per minute, wherein the iron-based material is stainless steel.

A further non-limiting embodiment of any of the foregoing examples includes, after the second heating step, abrading the substrate to remove any excess of the aluminum source material and the halide diffusion activator.

In a further non-limiting embodiment of any of the foregoing examples, the aluminum source material includes cobalt.

In a further non-limiting embodiment of any of the foregoing examples, the aluminum source material is $Co_2Al_5$.

In a further non-limiting embodiment of any of the foregoing examples, the aluminum source material consists of aluminum and cobalt.

In a further non-limiting embodiment of any of the foregoing examples, the substrate is a metallic interconnect of an electrochemical device.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
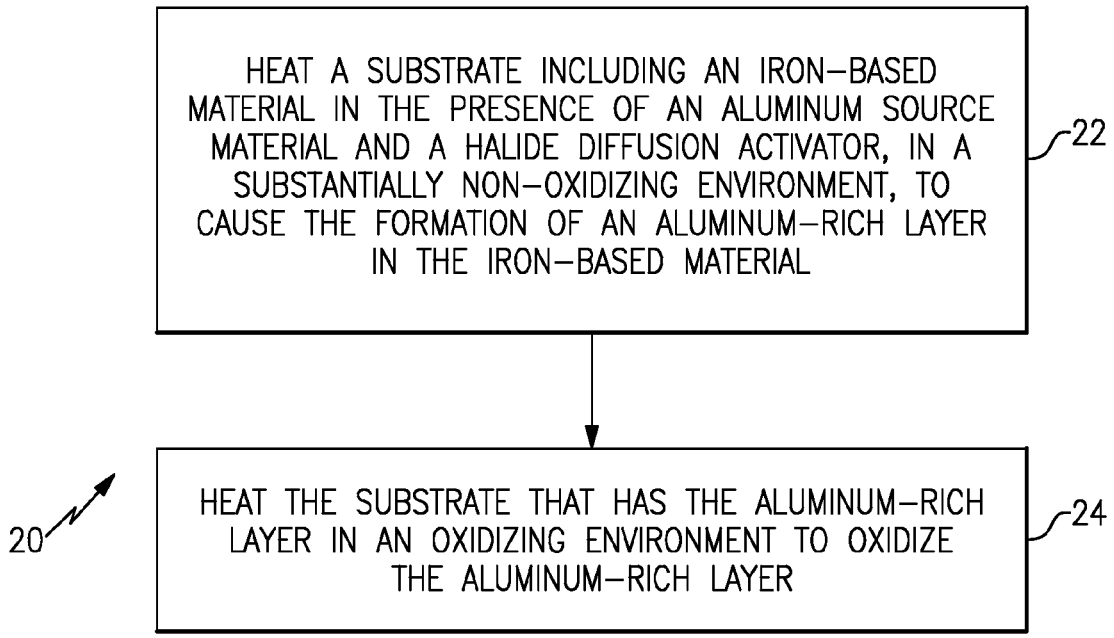
FIG. 1 shows an example method of coating an iron-based article.

FIG. 1 shows selected portions of an example method 20 of coating an iron-based article. As will be appreciated, the example method 20 can be used to apply aluminum-based coatings on iron-based articles, such as articles used in gas turbine engines or fuel cells.

As shown in FIG. 1, the method 20 includes a first heating step 22 and a second heating step 24. It is to be understood that the first heating step 22 and the second heating step 24 can be used in combination with other fabrication steps related to or in addition to the process to form the aluminide coating on the iron-based article.

The first heating step 22 includes heating a substrate including an iron-based material in the presence of an aluminum source material and a halide diffusion activator. The halide diffusion activator promotes the volatilization and diffusion of the aluminum. The heating is conducted in a substantially non-oxidizing environment to cause the formation of an aluminum-rich layer in the iron-based material, while reducing or eliminating oxidation of the aluminum. The aluminum-rich layer can include intermetallic aluminide phases, such as $Fe_3Al$, FeAl, $Fe_4Al_{13}$, etc.

The second heating step 24 includes heating the substrate that has the aluminum-rich layer in an oxidizing environment to oxidize the aluminum and the aluminum-rich layer to alumina ($Al_2O_3$). In one example, the alumina is or includes alpha alumina. In other examples, the oxidized aluminum may also include metastable hydroxide phases.

The following examples will further illustrate aspects of the method 20. It is to be understood that the example can be independent of one another or used in any combination with each other. In one example, the iron-based material is or includes stainless steel, such as ferritic or austenitic stainless steel. The substrate that is formed of the iron-based material may have the geometry of the end-use article, such as a metallic "picture frame" of a fuel cell, a periphery area of a separator plate of a fuel cell and/or a metallic component outside of an electron or ion flow area of a fuel cell. In stainless steel, the alumina coating passivates the surface to reduce oxygen infiltration and reaction with alloy elements of the stainless steel. The alumina also serves as a barrier to the volatile loss of chromia from the stainless steel, which can occur in fuel cells or other applications that operate at elevated temperatures in the presence of water vapor.

In a further example, the aluminum source material and the halide diffusion activator are provided in a carrier solvent as a slurry. Optionally, the slurry can also include an inert filler material, such as alumina. In one example, the carrier solvent is N-methylpyrrolidone (NMP solvent). The halide diffusion can be $AlF_3$ or $AlCl_3$ but is not limited to these.

In a further example, the aluminum source material includes cobalt and aluminum. In a further example, the aluminum source material has only the cobalt and the aluminum, to the exclusion of all other metals. In one example, the aluminum source material is $Co_2Al_5$. In one example, the slurry has a composition including 43.5-46.5 wt. % cobalt-aluminum powder, 3.3-3.7 wt. % hydroxyl propyl cellulose, 0.5-5.5 wt. % lithium fluoride and a remainder of ethylene glycol monoethyl ether. In a further example, the slurry composition includes only the above-listed constituents.

The slurry can be applied to selected surfaces of the substrate on which the coating is to be formed. For example, the slurry can be applied by painting, dipping or spraying, but is not limited to such application techniques.

After applying the slurry to the substrate, the substrate is then heated in the first heating step 22. The aluminum of the aluminum source reacts with the halide to form an aluminum halide gas which diffuses into the iron-based material at a much faster rate than diffusion of aluminum into nickel-based superalloys. Thus, the temperatures that are used to produce aluminum diffusion coatings on nickel-based superalloys are not applicable in processing of the iron-based material. In this regard, the heating temperature for the first heating step 22 can be selected in coordination with the melting temperature of the iron-based material. In one example, the relationship between the heating temperature and the melting temperature of the iron-based material is represented by a ratio of the melting temperature to the heating temperature. In one example, the ratio of the melting temperature to the heating temperature is 1.5-2.1. The disclosed ratio facilitates the proper amount of diffusion of the aluminum into the iron-based material. In a further example, the ratio is 1.6-1.9.

In general, the melting temperature of the iron-based material, if stainless steel, is approximately 1325°-1530° C. The selected heating temperature of the first heating step 22 is 750°-850° C. In a further example, the selected heating temperature of the first heating step 22 is 800°-825° C. The heating temperature of 800°-825° C. facilitates the later removal of any excess of the aluminum source material and the halide diffusion activator from the substrate after the second heating step 24. That is, within the temperature range of 800°-825° C., for stainless steel, any excess aluminum source material and halide diffusion activator can be relatively easily removed from the substrate by light abrasion and more costly and time consuming heavy abrasion is thereby avoided.

In a further example, the first heating step 22 is conducted in a substantially non-oxidizing environment. A retort furnace can be used to control the heating environment. The substantially non-oxidizing environment is primarily an inert gas that is unreactive or substantially unreactive with the aluminum (e.g., argon). Further, the environment has an oxygen concentration of less than about 10 parts-per-million and an overall pressure that is ambient or close to ambient (pressure of 14.7-19.7 psia). Thus, vacuum processes that are required for aluminum diffusion coating of nickel-based superalloys are not needed for processing the iron-based material. In other examples, the substantially non-oxidizing environment can include a small amount of hydrogen to reduce any oxides that may form. In one example, the hydrogen is present in an amount up to 4 vol %, and in a further example is 2-4 vol %. In a further example, the substrate is at least partially enclosed in a titanium- and/or tantalum-containing enclosure. The titanium and/or tantalum of the enclosure serves as a getter to intercept any oxygen and thereby further reduce the formation of oxides from the aluminum or elements of the iron-based material. Given this description, it is to be understood that other oxygen getter materials may also be used.

After the first heating step 22, the second heating step 24 is conducted to convert the aluminum in the iron aluminide intermetallic phase to alumina. The second heating step 24 in one example is conducted at 800°-1000° C. in air.

After the second heating step, the substrate and alumina coating can be cooled at a predetermined cooling rate to reduce or eliminate thermal cracking of the alumina coating. In one example, the cooling rate is equal to or less than 10° C. per minute. In a further example, the cooling rate is 1°-2° C. per minute. The cooling rate can be controlled by using a controlled cooling environment, such as by flowing an inert process gas over the substrate and alumina coating.

The substrate and alumina coating can be further processed to remove any excess aluminum source material, inert filler material and halide diffusion activator from the surfaces thereof. In this regard, the substrate and alumina coating can be lightly abraded or grit blasted to remove the excess from the surfaces.

Figure 2:
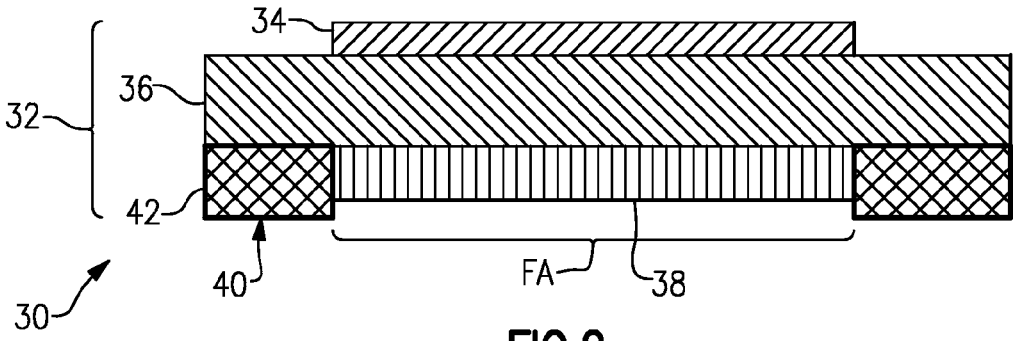
FIG. 2 shows an example electrochemical device that has an iron-based article processed according to the method disclosed herein.

FIG. 2 schematically shows selected portions of an example electrochemical device 30. In this example, the electrochemical device 30 includes a unit 32 that can be provided in a stack with similar units to provide electric current to an external circuit in a known manner. The unit 32 includes a fuel cell 34, a metallic support 36 and a metallic interconnect 38. In this example, the electrochemical device 30 includes a component 40 that is located laterally outside of an electron or ion flow area FA. The electron or ion flow area FA is the projected area under the fuel cell 34. As indicated above, the component 40 can be a metallic "picture frame," a periphery area of a separator plate and/or other metallic component. In this example, the component 40 is an iron-based article, such as stainless steel, that has been treated according to the method 20 disclosed herein to form an aluminum-based coating 42 thereon. The component 40 in this example therefore embodies the method 20. For example, the fuel cell 34 is a tri-layered arrangement, including a solid oxide electrolyte located between two ceramic electrodes. The metallic support 36 can be a rigidized foil support or other suitable support that is adapted to deliver fuel to the fuel cell 34. The metal interconnect 38 can be configured to deliver oxidant to the fuel cell 34.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A method of coating an iron-based article, the method comprising:

in a first heating step, heating a substrate including an iron-based material in the presence of an aluminum source material and a halide diffusion activator, in a substantially non-oxidizing environment, to cause formation of an aluminum-rich layer on at least a portion of the iron-based material; and in a second heating step, heating the substrate that has the aluminum-rich layer in an oxidizing environment to oxidize the aluminum in the aluminum-rich layer, wherein the first heating step includes heating at a heating temperature such that a ratio of the melting temperature of the iron-based material to the heating temperature is 1.5-2.1 and, after the second heating step, cooling the substrate at a rate of equal to or less than 10° C. per minute, and wherein the iron-based material is stainless steel.

2. The method as recited in claim 1, wherein the first heating step includes heating at a heating temperature such that a ratio of the melting temperature of the iron-based material to the heating temperature is 1.6-1.9.

3. The method as recited in claim 1, wherein the second heating step is conducted at a heating temperature of 800°-1000° C.

4. The method as recited in claim 1, wherein the cooling rate of is 1°-2° C. per minute.

5. The method as recited in claim 1, wherein the first heating step is conducted at a temperature of 750°-850° C.

6. The method as recited in claim 1, wherein the first heating step is conducted at a temperature of 800°-825° C.

7. The method as recited in claim 1, wherein the heating of the first heating step is conducted at a pressure of 14.7-19.7 psia.

8. The method as recited in claim 1, wherein the substantially non-oxidizing environment includes hydrogen in an amount of up to 4 vol %.

9. The method as recited in claim 1, wherein the substrate is at least partially enclosed in a titanium-containing enclosure.

10. The method as recited in claim 1, wherein the substrate is at least partially enclosed in a tantalum-containing enclosure.

11. The method as recited in claim 1, further comprising providing the aluminum source material and the halide diffusion activator in a slurry, and applying the slurry on the iron-based material.

12. The method as recited in claim 1, further comprising, after the second heating step, abrading the substrate to remove any excess of the aluminum source material and the halide diffusion activator.

13. The method as recited in claim 1, wherein the aluminum source material includes cobalt.

14. The method as recited in claim 1, wherein the aluminum source material is $Co_2Al_5$.

15. The method as recited in claim 1, wherein the aluminum source material consists of aluminum and cobalt.

16. The method as recited in claim 1, wherein the substrate is a metallic component of an electrochemical device, the metallic component being located laterally outside of an electron or ion flow area FA of the electrochemical device.

* * * * *